United States Patent [19]

Laing et al.

[11] 3,959,609

[45] May 25, 1976

[54] DOUBLE ACTION SWITCH WITH BLOCKING INSERT FOR ONE ACTION

[75] Inventors: Graham Stirling Laing; Ronald Joseph Morrell, both of London, Canada

[73] Assignee: Northern Electric Company Limited, Montreal, Canada

[22] Filed: Nov. 25, 1974

[21] Appl. No.: 527,046

[52] U.S. Cl. ..... 200/4; 200/322
[51] Int. Cl.[2] ..... H01H 9/00
[58] Field of Search ..... 200/4, 327, 321, 322

[56] References Cited

UNITED STATES PATENTS

| | | | |
|---|---|---|---|
| 1,482,911 | 5/1924 | Catlin | 200/4 |
| 3,384,727 | 5/1968 | Zavertnik et al. | 200/322 |

*Primary Examiner*—Robert K. Schaefer
*Assistant Examiner*—M. Ginsburg
*Attorney, Agent, or Firm*—Sidney T. Jelly

[57] ABSTRACT

A double action switch, for example having both a rotary action and a pushbutton action, is provided with a removable insert which blocks one action while permitting the other. The switch has a frame in which a shaft is supported, for rotational and axial movements. An insert slides into the frame and engages with the shaft to prevent movement of the shaft for one of the actions, while permitting movement of the shaft for the other action. The switch is particularly useful in a telephone unit in which one or more optional operational features are available. The units can be produced, wired and ready for all options, only those required and paid for being available by use of inserts in the switches.

5 Claims, 5 Drawing Figures

DOUBLE ACTION SWITCH WITH BLOCKING INSERT FOR ONE ACTION

This invention relates to a double action switch, and particularly to a switch having rotary action and a pushbutton action, with a blocking insert which permits pushbutton action but prevents rotary action.

Telephone sets can be manufactured to provide differing forms of service. In many cases the services consist of basic features with one or more optionally additive features. To reduce stock inventory and for maximum production efficiency it is often useful to use a common housing and common controls for all telephone sets, independent of the forms of service to be provided. In such instances certain controls may have more than one function when additional service features are provided. Further, all the essential circuit and other details may be available in the telephone set but it may be desired to prevent use of such circuits, and other details, at some time.

The invention provides a switch which has two actions, each action operative to control a separate feature or service, and with a blocking insert which, when inserted, will prevent operation of the switch in one way without interfering with operation of the switch in the other way. Specifically, with one form of switch, there is provided both rotary and pushbutton operation, and a blocking insert can be used to prevent rotary operation while still permitting pushbutton operation.

The invention will be readily understood by the following description of one embodiment, by way of example, in conjunction with the accompanying drawings, in which.

Figures 1, 2, 3, 4, 5:
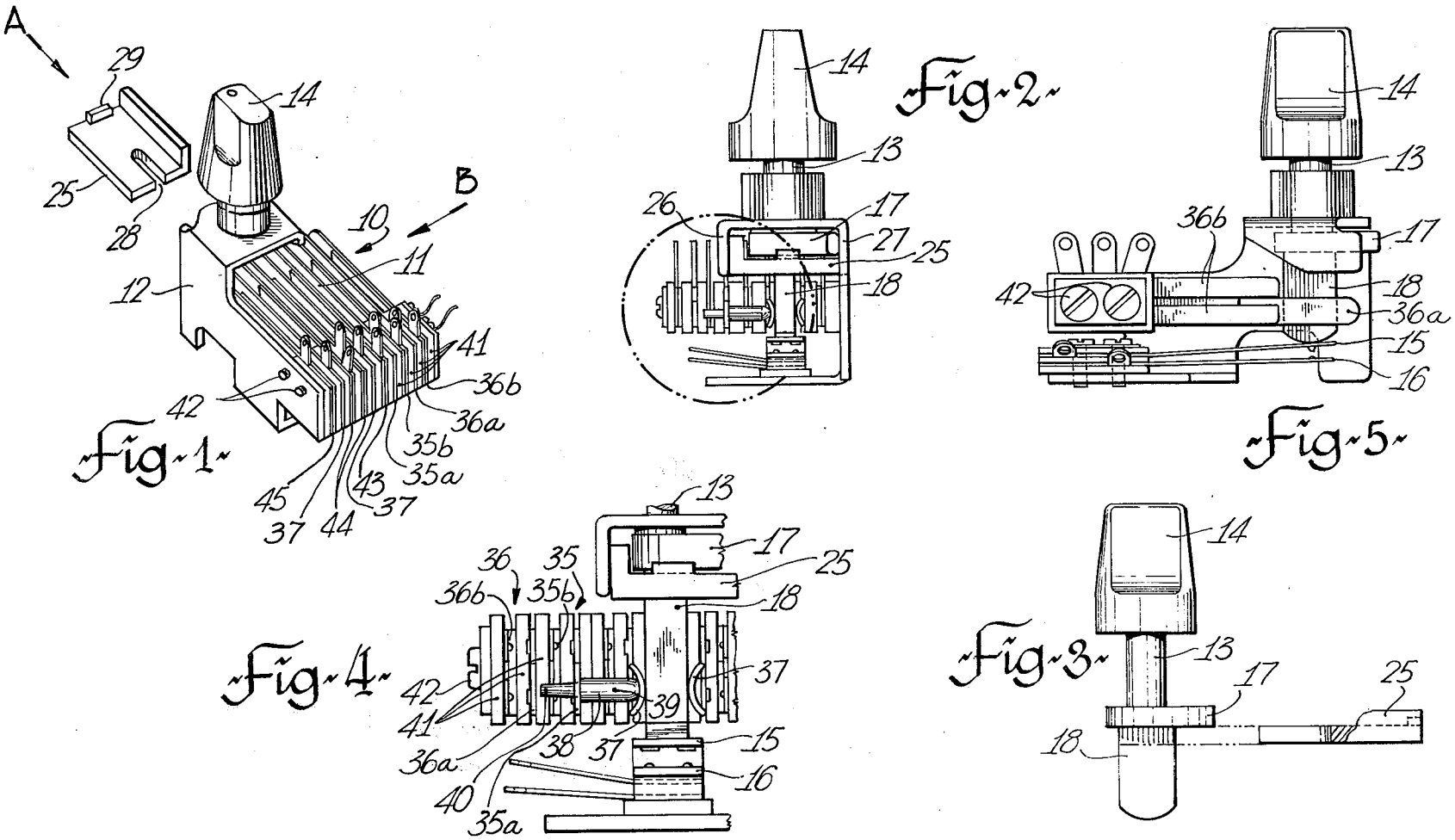
FIG. 1 is a perspective view of a switch with a blocking insert shown removed.
FIG. 2 is a view in the direction of arrow A in FIG. 1, with the blocking insert in position in the switch.
FIG. 3 is a side view of the operating knob and shaft of the switch in FIGS. 1 and 2.
FIG. 4 is an enlarged view of the part of the switch in circle of FIG. 2.
FIG. 5 is a view in the direction of arrow B in FIG. 1.

Illustrated in FIGS. 1 and 2 is a switch 10 having a body portion 11 having a frame 12. At one end of the frame 12 is mounted a shaft 13 having a knob 14 thereon. The shaft rests upon a resilient contact 15 and can be moved axially, as a pushbutton, by pressure on the knob 14. Such pressure, causing axial movement of the shaft 13, closes contact 15 onto a further contact 16. The shaft 13 can also be rotated by twisting the knob 14. As can be seen in FIG. 3, the shaft 13 has an extension 17, also seen in FIG. 2. Also formed on the shaft at its lower end is a flat blade-like portion 18. The radial extension acts to limit rotation of the knob, normally being in contact with one side of the frame 12 and contacting the other side of the frame when the knob 14 is rotated.

The flat portion 18 actuates two sets of contacts 35 and 36. Also positioned on each side of portion 18 is a spring lever member 37. These members 37 are spring cantilever members and act on the portion 18 to maintain it in a central position. Extending from one lever member 37 is rod 38 of insulating material. Rod 38 has the larger diameter portion 39 in contact with lever member 37 and a small diameter portion 40 which passes through a hole in member 35*a* of contacts 35.

The end of the small diameter portion 40 is spaced a short distance from member 36*a* of contacts 36. When the knob is rotated, turning the flat portion 18, member 35*a* is pushed into contact with a bifurcated member 35*b* to make one contact, and also the end of portion 40 pushes member 36*a* into contact with bifurcated member 36*b* to make a second contact. The contact members 35*a*, 35*b*, 36*a* and 36*b* are mounted with insulating members 41 between and fastened with two screws 42. The near ends of the contact members and insulating members are seen in FIG. 1.

At the same time as the rotation of the flat portion 18 closes the sets of contacts 35 and 36, it can be opening and closing further sets of contacts indicated at 43, 44 and 45 in FIG. 1 and partially in FIG. 4. The sets of contacts 35 and 36, spring lever members 37 and further sets of contacts 43, 44 and 45, with interleaved insulating members, are assembled into a stack by the screws 42.

A blocking insert 25 is provided which slides into the frame 12. The insert fits between two side members 26 and 27 of the frame 12 and has a slot 28 which slides over the flat portion 18 of the shaft 13. The insert is a tight sliding fit on the flat portion 18 and will move axially with the shaft 13 but will prevent rotation of the shaft. Removal of the insert 25, facilitated by a small protrusion 29 on the outer edge of the insert, frees the shaft for rotational movement.

The invention provides a switch having a double action, that is has two separate actions independent of each other, and one action can be prevented from occuring while permitting the other action without restraint. Thus one service can be provided for a telephone set with the switch blocked, and a further service provided at any time by removal of the blocking insert. This reduces stock inventory and also avoids having to change the switch when a change in service provided is desired. The ability to remove and reinsert the insert makes it unnecessary to change the wiring of the set in the field. Also, it is possible to test all circuits during manufacture, for both services, without having to make changes in the circuitry for testing the alternative services.

What is claimed is:

1. A double acting switch comprising:

a frame including two spaced apart side members;

a first series of contact members mounted on said frame;

a second series of contact members mounted on said frame;

a shaft supported in said frame, said shaft mounted for rotational movement about a longitudinal axis of the shaft to actuate said first series of contact members and also for axial movement along said longitudinal axis to actuate said second series of contact members;

a removable and replaceable insert in said frame, said insert slidable into said frame between said spaced apart side members;

a formation on said shaft, and a cooperative formation in said insert, said formations interengaging, when said insert is in said frame, to prevent one of said rotational and axial movements and to permit the other of said rotational and axial movements of said shaft, removal of said insert permitting both said rotational and axial movements.

2. A switch as claimed in claim 1, said formation on said shaft comprising a flat blade-like portion and said formation on said insert comprising a slot encompassing said blade-like portion of said shaft, said insert adapted to slide in said frame along said axis to permit said axial movement but prevent said rotational movement.

3. A switch as claimed in claim 2, wherein said flat blade-like portion is at a lower end of said shaft, said second series of contact members mounted below said lower end of said shaft for actuation by said axial movement of said shaft; means contacting at least one side surface of said flat portion and operative on rotation of said shaft to actuate said first series of contact members.

4. A switch as claimed in claim 3 including a third series of contact members actuated by said rotational movement of said shaft, including an operating member extending between said means contacting said side surface of said flat portion and said third series of contact members.

5. A switch as claimed in claim 1 including a radial extension on said shaft to limit rotational movement of said shaft.

* * * * *